US009776301B2

(12) United States Patent
Yamamoto

(10) Patent No.: US 9,776,301 B2
(45) Date of Patent: Oct. 3, 2017

(54) SHOT PEENING DEVICE AND SHOT PEENING METHOD

(71) Applicant: SINTOKOGIO, LTD., Nagoya-shi, Aichi (JP)

(72) Inventor: Masatoshi Yamamoto, Toyokawa (JP)

(73) Assignee: SINTOKOGIO, LTD., Nagoya-shi, Aichi (JP)

( * ) Notice: Subject to any disclaimer, the term of this patent is extended or adjusted under 35 U.S.C. 154(b) by 557 days.

(21) Appl. No.: 14/373,460

(22) PCT Filed: Oct. 31, 2012

(86) PCT No.: PCT/JP2012/078149

§ 371 (c)(1),
(2) Date: Jul. 21, 2014

(87) PCT Pub. No.: WO2013/121632

PCT Pub. Date: Aug. 22, 2013

(65) Prior Publication Data

US 2014/0360241 A1 Dec. 11, 2014

(30) Foreign Application Priority Data

Feb. 13, 2012 (JP) ..... 2012-028952

(51) Int. Cl.
*B24C 3/24* (2006.01)
*B24C 3/20* (2006.01)
(Continued)

(52) U.S. Cl.
CPC ..... *B24C 3/20* (2013.01); *B21D 31/06* (2013.01); *B24C 1/00* (2013.01); *B24C 1/10* (2013.01);
(Continued)

(58) Field of Classification Search
CPC .... B24C 1/00; B24C 1/10; B24C 3/08; B24C 3/20; B24C 3/24; B24C 9/00; B21D 31/06
(Continued)

(56) References Cited

U.S. PATENT DOCUMENTS 5,272,897 A 12/1993 Wern
9,126,308 B2 * 9/2015 Yamamoto ..... B24C 1/10
(Continued)

FOREIGN PATENT DOCUMENTS

DE 44 08 643 C1 6/1995
JP H01-271175 A 10/1989
(Continued)

OTHER PUBLICATIONS

International Preliminary Report on Patentability ("IPRP"), including PCT/IB/373 and English translation of PCT/ISA/237, dated Aug. 28, 2014 that issued in related PCT/JP2012/078149 application.

*Primary Examiner* — David B Jones
(74) *Attorney, Agent, or Firm* — Drinker Biddle & Reath LLP

(57) ABSTRACT

A plurality of rotatable small table are disposed on a rotatable large table, and a workpiece is mounted on the small tables. Above a projection range in the large table, a pressing part is provided. The pressing part is elevated and lowered by an elevating/lowering mechanism between a withdrawn position spaced above the workpiece on the small table and a pressing position for pressing the workpiece on the small table from above. Also, the pressing part is rotationally driven coaxially with a rotary shaft of the small table and in the same rotating direction and at the same rotating speed as the small table, by a third drive mechanism.

17 Claims, 11 Drawing Sheets

(51) Int. Cl.

| | |
|---|---|
| ***B24C 1/10*** | (2006.01) |
| ***B21D 31/06*** | (2006.01) |
| ***B24C 3/08*** | (2006.01) |
| ***B24C 9/00*** | (2006.01) |
| ***B24C 1/00*** | (2006.01) |

(52) U.S. Cl.
CPC ..... *B24C 3/08* (2013.01); *B24C 3/24* (2013.01); *B24C 9/00* (2013.01)

(58) Field of Classification Search
USPC ..... 72/53
See application file for complete search history.

(56) References Cited

U.S. PATENT DOCUMENTS

| | | | | |
|---|---|---|---|---|
| 9,163,295 | B2 * | 10/2015 | Yamamoto | B24C 1/10 |
| 9,248,546 | B1 * | 2/2016 | Wern | B23Q 11/0883 |

FOREIGN PATENT DOCUMENTS

| | | | |
|---|---|---|---|
| JP | H02-4755 | U | 1/1990 |
| JP | H08-197428 | A | 8/1996 |
| JP | 2001-260027 | A | 9/2001 |
| JP | 2002-292568 | A | 10/2002 |
| JP | 2006-055977 | A | 3/2006 |

* cited by examiner

SHOT PEENING DEVICE AND SHOT PEENING METHOD

TECHNICAL FIELD

The present invention relates to a shot processing device and a shot processing method.

BACKGROUND ART

In a shot processing device, a device provided with a plurality of rotating small tables on a revolving large table is known (for instance, see Patent Literature 1). In such a device, a workpiece is installed on the small table, and the workpiece that is rotated together with the small table is projected in a projection zone.

CITATION LIST

Patent Literature

[Patent Literature 1] Japanese Patent Laid-Open No. 1-271175

SUMMARY OF INVENTION

Technical Problem

However, in the Patent Literature 1, a structure of projecting a projection material to the workpiece while stably rotating the workpiece together with the small table is not disclosed, and there is room for improvement for this point.

In this technical field, there is a demand for a shot processing device and a shot processing method capable of projecting a projection material to a workpiece while stably rotating the workpiece together with a small table (second rotary table).

Solution to Problem

A shot processing device according to one aspect of the present invention includes: a projector which projects a projection material to a workpiece; a rotatable first rotary table disposed at a position including a projection range where the projection material is projected by the projector and a non-projection range outside the projection range; a first drive mechanism which rotationally drives the first rotary table; a plurality of second rotary tables which are disposed on the first rotary table and include a rotary shaft parallel to a rotary shaft of the first rotary table to be rotatable, and on which the workpiece is to be mounted; a second drive mechanism which rotationally drives the second rotary table; a pressing part which is provided above the projection range on the first rotary table, and which is movable up and down between a withdrawn position spaced above the workpiece on the second rotary table and a pressing position for pressing the workpiece on the second rotary table from above; an elevating/lowering mechanism which elevates and lowers the pressing part; and a third drive mechanism which rotationally drives the pressing part coaxially with the rotary shaft of the second rotary table and in the same rotating direction and at the same rotating speed as the second rotary table.

According to this shot processing device, the first rotary table is disposed at the position including the projection range where the projection material is projected by the projector and the non-projection range outside the projection range and is made rotatable. The first rotary table is rotationally driven by the first drive mechanism. Also, the plurality of second rotary tables are disposed on the first rotary table, the second rotary tables include the rotary shaft parallel to the rotary shaft of the first rotary table and are made rotatable, and the workpiece is mounted. The second rotary table is rotationally driven by the second drive mechanism. Then, to the workpiece on the second rotary table, the projection material is projected by the projector.

The pressing part is provided above the projection range in the first rotary table, and the pressing part is movable up and down between the withdrawn position spaced above the workpiece on the second rotary table and the pressing position for pressing the workpiece on the second rotary table from the upper side. The pressing part is elevated and lowered by the elevating/lowering mechanism, and is rotationally driven coaxially with the rotary shaft of the second rotary table and in the same rotating direction and at the same rotating speed as the second rotary table, by the third drive mechanism. Therefore, the projection material is projected while the workpiece is stably rotated.

In one embodiment, the elevating/lowering mechanism may include a servo cylinder.

In this case, since the elevating/lowering mechanism includes the servo cylinder, the workpiece is pressed with appropriate pressurizing force by the pressing part.

In one embodiment, the third drive mechanism may rotationally drive the pressing part continuously in states including the state where the workpiece is disposed in the projection range and the pressing part is lowered in a direction from the withdrawn position to the pressing position, the state where the workpiece is disposed in the projection range and the pressing part is disposed at the pressing position, and the state where the workpiece is disposed in the projection range and the pressing part is elevated in a direction from the pressing position to the withdrawn position.

By such a configuration, the pressing part is rotationally driven by the third drive mechanism not only when pressing the workpiece but also before and after that. Therefore, immediately after the workpiece is pressed by the pressing part, the second rotary table and the pressing part are synchronized, the workpiece is stably rotated, and the state continues while the workpiece is pressed by the pressing part.

In one embodiment, above the second rotary table, a pressing shaft which constitutes a part of the elevating/lowering mechanism and has the pressing part fixed to a lower end may be disposed coaxially with the rotary shaft of the second rotary table, and the pressing shaft may be constituted by connecting a plurality of shafts in series and have a detachable distal end shaft for fixing the pressing part on a lower part of the pressing shaft.

In this case, above the second rotary table, the pressing shaft to the lower end of which the pressing part is fixed and which constitutes a part of the elevating/lowering mechanism is disposed coaxially with the rotary shaft of the second rotary table. The pressing shaft is constituted by connecting the plurality of shafts in series and has the detachable distal end shaft for fixing the pressing part on the lower part thereof, and thus the distal end shaft can be replaced when the distal end shaft is worn away by the projection material.

In one embodiment, the first drive mechanism may include an index device, the second drive mechanism may include a drive motor for the second drive mechanism, the third drive mechanism may include a drive motor for the third drive mechanism, and the index device, the drive motor for the second drive mechanism, and the drive motor for the third drive mechanism may be all disposed above a device ceiling part.

In this case, since the index device for the first drive mechanism, the drive motor for the second drive mechanism and the drive motor for the third drive mechanism are all disposed above the device ceiling part, maintenance is facilitated and a compact configuration is made possible.

In one embodiment, there may be provided a projection area which is a part of space above the first rotary table, and in which projection is performed by the projector to the workpiece, a carry-in area which is a part of the space above the first rotary table and is adjacent to a carry-in port for carrying in the workpiece, and a carry-out area which is a part of the space above the first rotary table and is adjacent to a carry-out port for carrying out the workpiece.

In this case, the workpiece is carried in from the carry-in port to the carry-in area, made to reach the projection area by the rotation of the first rotary table, projected by the projector in the projection area, made to reach the carry-out area by the rotation of the first rotary table, and carried out from the carry-out area through the carry-out port.

In one embodiment, there may be provided a projection area which is a part of space above the first rotary table, and in which projection is performed by the projector to the workpiece, and a carry-in/carry-out area which is a part of the space above the first rotary table and is adjacent to a carry-in/carry-out port for carrying in and out the workpiece.

In this case, the workpiece is carried in from the carry-in/carry-out port to the carry-in/carry-out area, made to reach the projection area by the rotation of the first rotary table, projected by the projector in the projection area, made to reach the carry-in/carry-out area by the rotation of the first rotary table, and carried out from the carry-in/carry-out area through the carry-in/carry-out port.

In one embodiment, a blow-down area for blowing down the projection material on the workpiece may be provided in a part of the space above the first rotary table, on the downstream side of the projection area in the rotating direction of the first rotary table and on the upstream side of the carry-out area in the rotating direction of the first rotary table, and a blowing device which has a blowing port disposed facing the blow-down area and is capable of blowing air to the workpiece may be provided.

In this case, the blow-down area for blowing down the projection material on the workpiece is provided in the space above the first rotary table, more on the downstream side of the rotating direction of the first rotary table than the projection area and more on the upstream side of the rotating direction of the first rotary table than the carry-out area. Then, the blowing port of the blowing device is disposed facing the blow-down area, the blowing device is capable of blowing air to the workpiece, and thus the projection material or the like remaining on the workpiece is blown down by blowing of air by the blowing device.

In one embodiment, a blow-down area for blowing down the projection material on the workpiece may be provided in a part of the space above the first rotary table, on the downstream side of the projection area in the rotating direction of the first rotary table and on the upstream side of the carry-in/carry-out area in the rotating direction of the first rotary table, and a blowing device which has a blowing port disposed facing the blow-down area and is capable of blowing air to the workpiece may be provided.

In this case, the blow-down area for blowing down the projection material on the workpiece is provided in the space above the first rotary table, more on the downstream side of the rotating direction of the first rotary table than the projection area and more on the upstream side of the rotating direction of the first rotary table than the carry-in/carry-out area. Then, the blowing port of the blowing device is disposed facing the blow-down area, the blowing device is capable of blowing air to the workpiece, and thus the projection material or the like remaining on the workpiece is blown down by blowing of air by the blowing device.

A shot processing method according to another aspect of the present invention includes: a mounting step of mounting a workpiece on a second rotary table which is disposed on a rotatable first rotary table and includes a rotary shaft parallel to a rotary shaft of the first rotary table to be rotatable; a rotating step of rotationally driving the first rotary table about the rotary shaft of the first rotary table and rotationally driving the second rotary table about the rotary shaft of the second rotary table at least in a projection range where a projection material is projected, after the mounting step; a pressing step of pressing the workpiece from above after the rotating step, by a pressing part rotationally driven coaxially with the rotary shaft of the second rotary table and in the same rotating direction and at the same rotation speed as the second rotary table; and a projecting step of projecting the projection material to the workpiece, after the pressing step.

According to the shot processing method, in the mounting step, the workpiece is mounted on the second rotary table. The second rotary table is disposed on the rotatable first rotary table and includes the rotary shaft parallel to the rotary shaft of the first rotary table to be rotatable. Then, in the rotating step after the mounting step, the first rotary table is rotationally driven about the rotary shaft thereof and the second rotary table is rotationally driven about the rotary shaft thereof at least in the projection range where the projection material is projected. Then, in the pressing step, by the pressing part rotationally driven coaxially with the rotary shaft of the second rotary table and in the same rotating direction and at the same rotating speed as the second rotary table, the workpiece is pressed from the upper side after the rotating step. Then, in the projecting step after the pressing step, the projection material is projected to the workpiece. Thus, the projection material is projected while the workpiece is stably rotated.

Advantageous Effects of Invention

As described above, by the shot processing device and the shot processing method according to various aspects and embodiments of the present invention, the projection material can be projected to the workpiece while the workpiece is stably rotated together with the second rotary table.

BRIEF DESCRIPTION OF DRAWINGS

FIG. 9(A) is a plan view of the drive system of the small table. FIG. 9(B) is a front view of the drive system of the small table.

DESCRIPTION OF EMBODIMENTS (Configuration of Embodiment)

A shot peening device 10 (stress peening machine) as the shot processing device according to one embodiment of the present invention will be described using FIG. 1 to FIG. 10. An arrow FR appropriately illustrated in the figures indicates a front side of the device front view, an arrow UP indicates a device upper side, and an arrow LH indicates a left side of the device front view.

Figure 1:
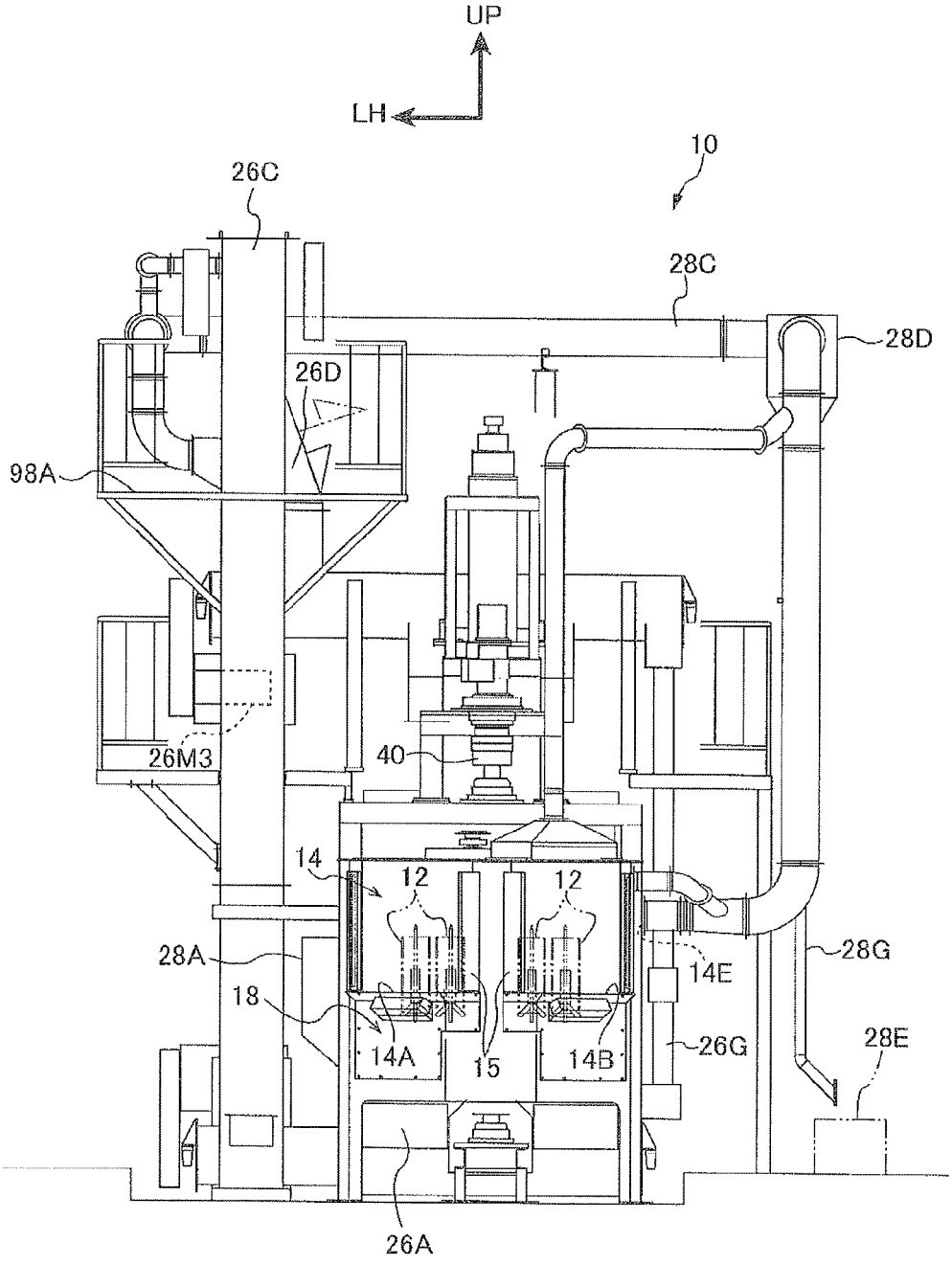
FIG. 1 is a front view illustrating a shot peening device according to one embodiment.
Figure 2:
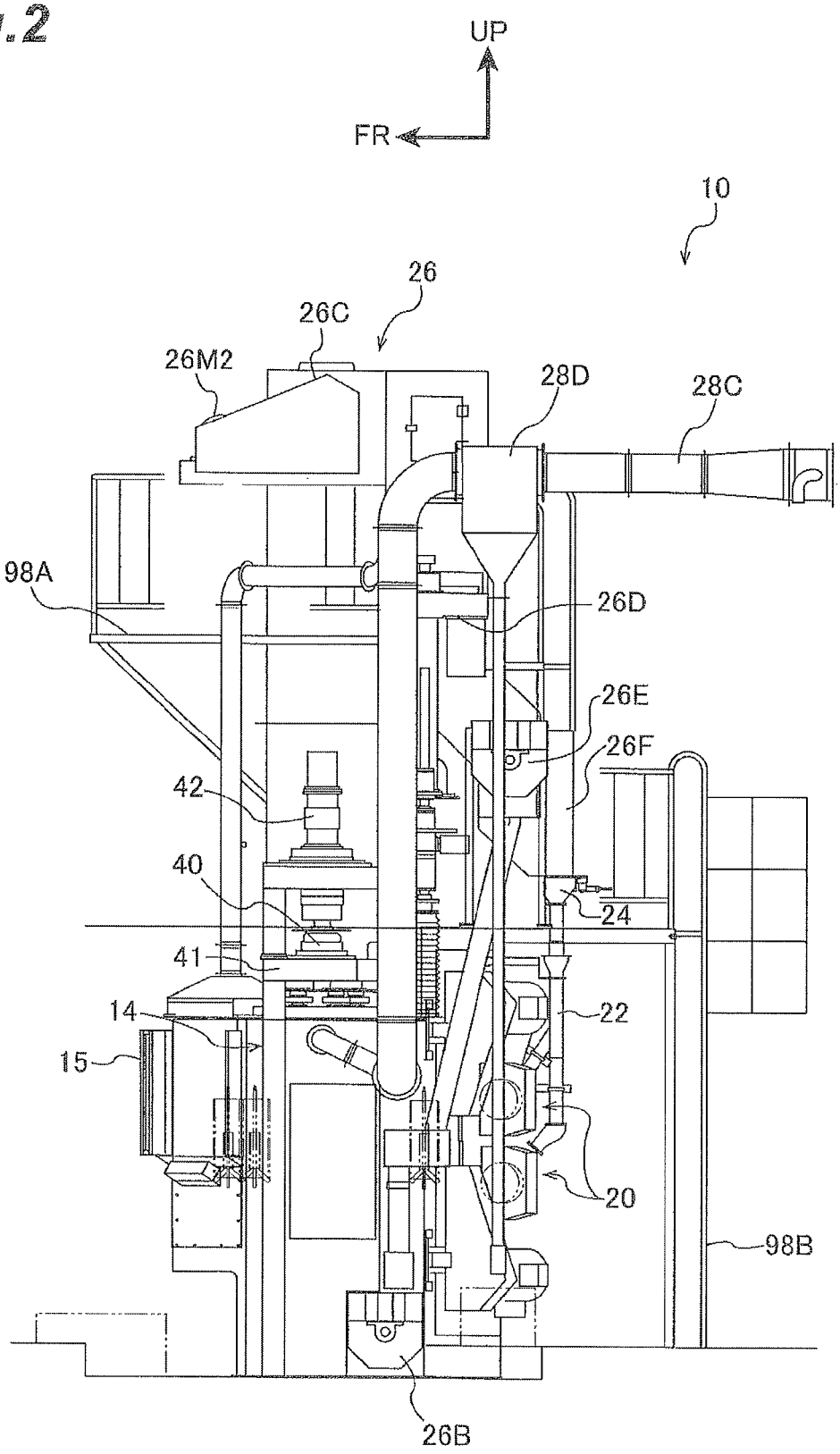
FIG. 2 is a right side view illustrating the shot peening device according to one embodiment.
Figure 3:
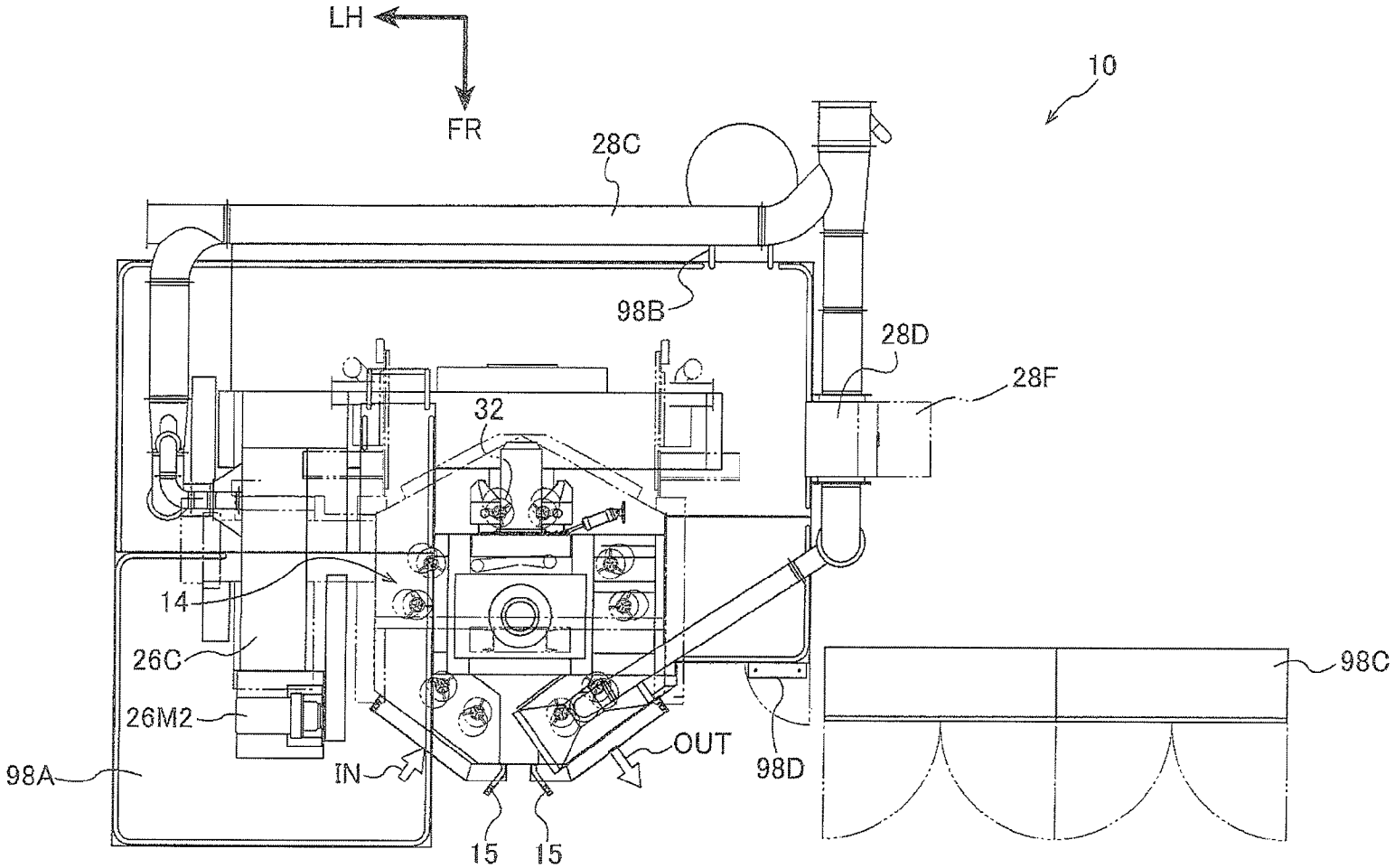
FIG. 3 is a plan view illustrating the shot peening device according to one embodiment.

The shot peening device 10 is illustrated by a front view in FIG. 1, the shot peening device 10 is illustrated by a right side view in FIG. 2, and the shot peening device 10 is illustrated by a plan view in FIG. 3. As a workpiece 12 of shot peening, an object which needs to be held by applying prescribed stress during shot peening, a product such as a compression coil spring (an element recognized as a "spring member" in a broad sense) for instance, is applicable.

As illustrated in FIG. 1, the shot peening device 10 includes a cabinet 14. In the inside of the cabinet 14, a projection chamber R3 (see FIG. 4) for processing a surface of the workpiece 12 by projecting a projection material to the workpiece 12 is formed. Also, in the cabinet 14, a carry-in port 14A for carrying in the workpiece 12 and a carry-out port 14B for carrying out the workpiece 12 are formed. The carry-in port 14A and the carry-out port 14B are provided with an area sensor 15.

On a lower part inside the cabinet 14, a product mounting part 18 for mounting the workpiece 12 is provided. The product mounting part 18 will be described later in detail. As illustrated in FIG. 2, on a side part of the cabinet 14, a plurality (two upper and lower, four in total, in this embodiment) of centrifugal projectors 20 are provided. The projector 20 is capable of imparting centrifugal force to a projection material (shot, a steel ball as one example in this embodiment) by the rotation of an impeller.

Figure 4:
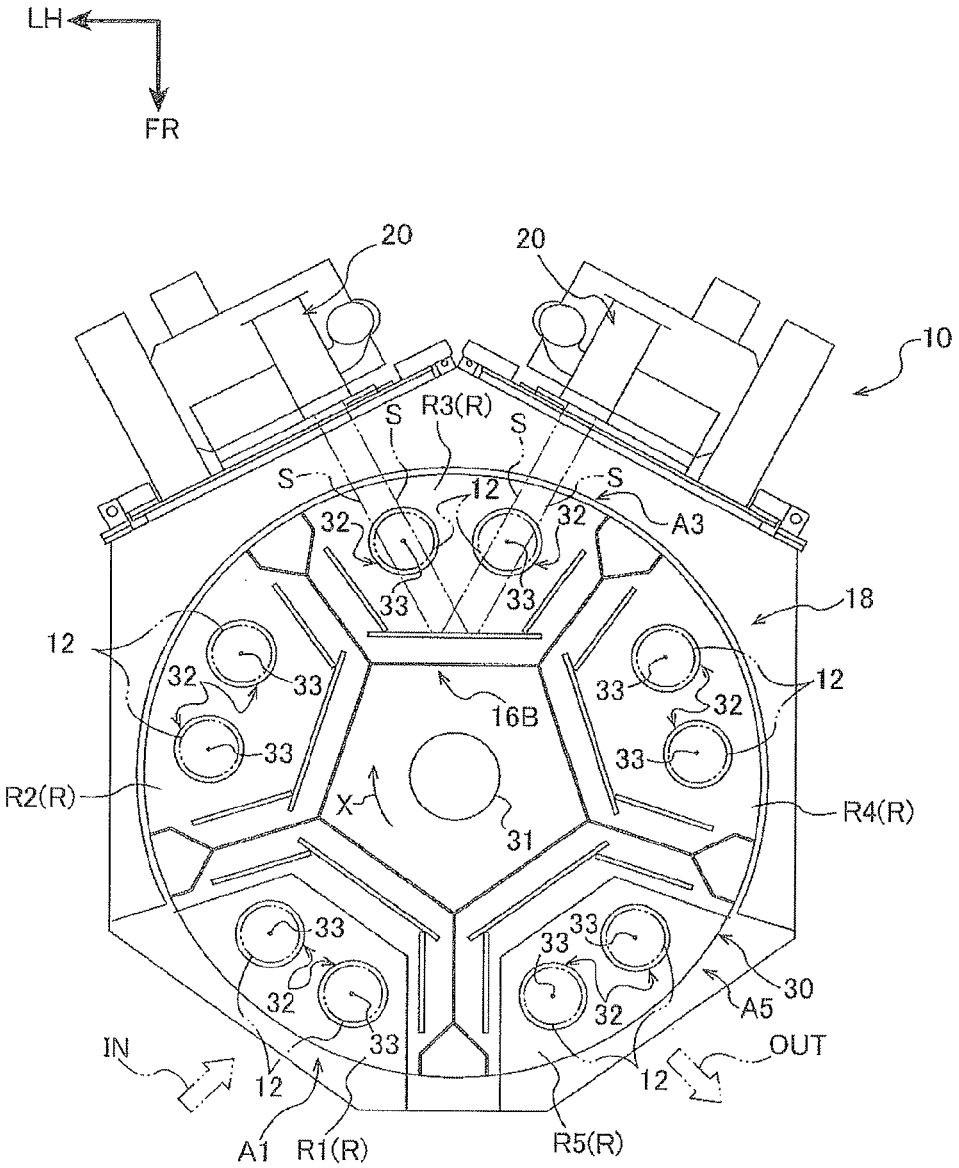
FIG. 4 is a skeleton configuration diagram schematically illustrating a configuration of a product mounting part and a disposing position of a centrifugal projector and the like in the shot peening device according to one embodiment, by a plane cross sectional view.

In FIG. 4, the configuration of the product mounting part 18 and the disposing position of the projector 20 and the like are illustrated by a schematic skeleton configuration diagram of a closed cross sectional view. The projector 20 illustrated in FIG. 4 accelerates the projection material by the centrifugal force and projects the projection material to the workpiece 12 of the projection chamber R3. As illustrated in the schematic diagram of FIG. 10, the projector 20 is connected to a control part 70. As described later, the control part 70 controls the timing of the projection of the projector 20.

Figure 5:
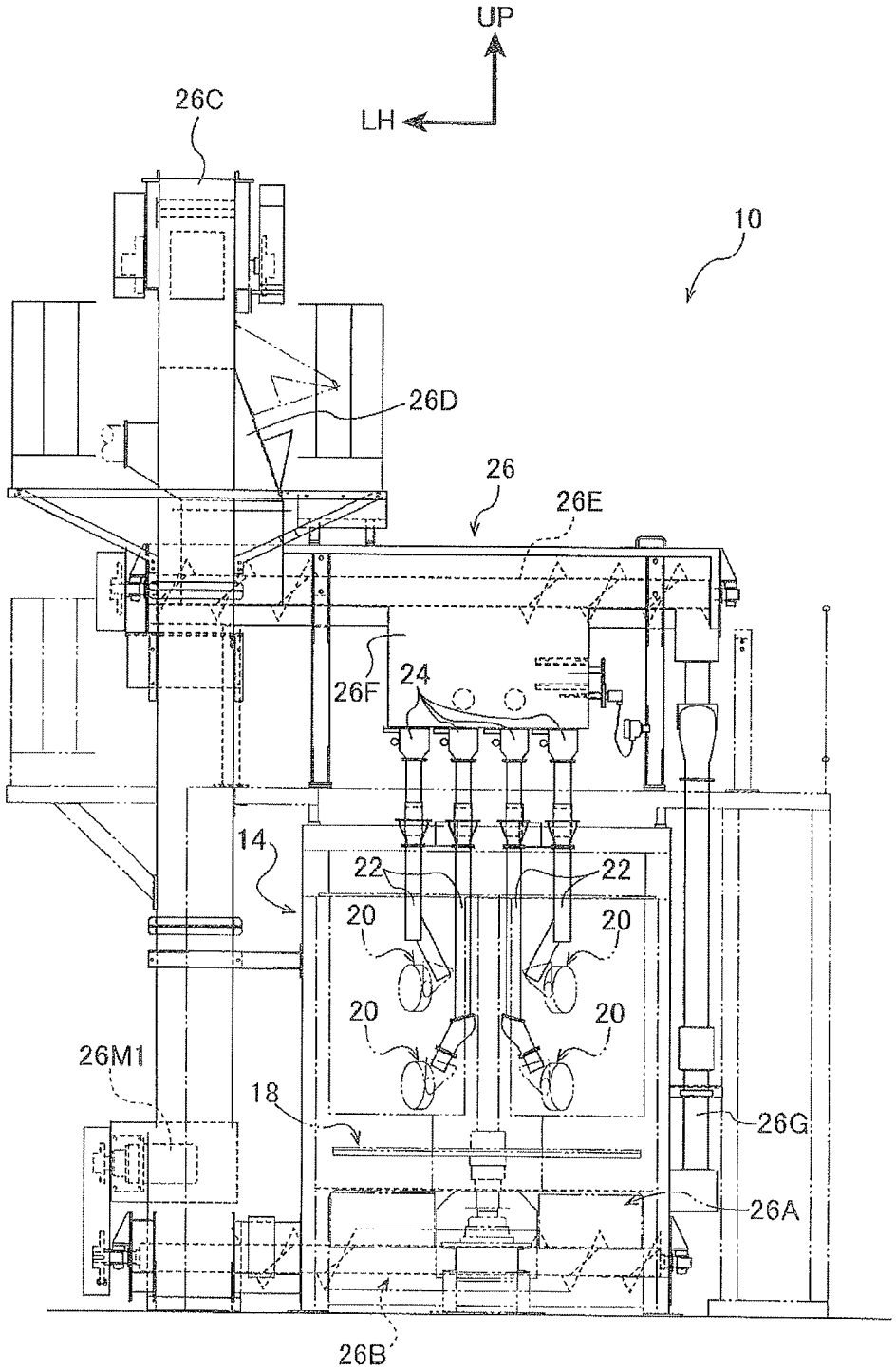
FIG. 5 is a skeleton configuration diagram illustrating a configuration for circulating the projection material in the shot peening device according to one embodiment by a device front view.

In FIG. 5, a configuration for circulating the projection material in the shot peening device 10 is illustrated by a skeleton configuration diagram of a device front view. As illustrated in FIG. 5, a lower end of an introduction pipe 22 for projection material supply is provided above the projector 20, and a flow rate adjusting device 24 for adjusting the flow rate of the projection material is provided on an upper end of the introduction pipe 22. The flow rate adjusting device 24 limits the amount of the projection material to be supplied to the introduction pipe 22 to an amount optimum for the projection, and by supplying the optimum amount of the projection material to the projector 20, the projection material is projected at an optimum speed from the projector 20. The projector 20 is connected through the introduction pipe 22 and the flow rate adjusting device 24 to a circulation device 26. The circulation device 26 is a device for carrying the projection material projected by the projector 20 and circulating the projection material to the projector 20, and a hopper 26A for recovering the projection material is provided below the product mounting part 18 inside the cabinet 14. Below the hopper 26A, a screw conveyor 26B is provided.

The screw conveyor 26B is disposed horizontally with a device left-right direction as a longitudinal direction, and is driven by a drive motor 26M1. The screw conveyor 26B, by being driven by the drive motor 26M1, carries the projection material that flows down from the hopper 26A to a device left side along the longitudinal direction of the screw conveyor 26B. On the downstream side of the carrying direction of the screw conveyor 26B, a lower end side of a bucket elevator 26C extending in a device up-down direction is disposed. While detailed descriptions are omitted since the bucket elevator 26C is a well-known structure, an endless belt (not shown in the figure) is wound around pulleys (not shown in the figure) disposed at an upper part and a lower part of the shot peening device 10, and many buckets (not shown in the figure) are attached to the endless belt. The pulleys can be rotationally driven by a drive motor 26M2 (see FIG. 3). Thus, the bucket elevator 26C scoops up the projection material recovered (tentatively stored) by the screw conveyor 26B by the bucket, and carries the projection material inside the bucket to the upper side of the cabinet 14 by rotating the pulleys.

Also, near the upper side of the bucket elevator 26C, a separator 26D is disposed. The separator 26D has a function of separating the projection material carried by the bucket elevator 26C into the projection material of a usable particle size and the projection material of an unusable particle size. The separator 26D is communicated to the upstream side of a screw conveyor 26E, and makes only the projection material of the usable particle size flow to the upstream side of the screw conveyor 26E. The screw conveyor 26E is disposed horizontally with the device left-right direction as the longitudinal direction, and is driven by a drive motor 26M3 (see FIG. 1). The screw conveyor 26E is communicated to a projection material tank 26F, carries the projection material that flows in from the separator 26D to a device right side along the longitudinal direction of the screw conveyor 26E, and makes it flow to the projection material tank 26F. The projection material tank 26F is a temporary storage tank for supplying the projection material to the flow rate adjusting device 24, and is disposed above the flow rate adjusting device 24. To the end on the downstream side of the carrying direction of the screw conveyor 26E, an upper end of an overflow pipe 26G is connected.

Meanwhile, as illustrated in FIG. 1, a ventilator 28A (ventilating device) is disposed at the sidewall part of the cabinet 14. Also, a duct 28C is connected to a suck-out port 14E of the cabinet 14, and dust generated inside the cabinet 14 is sucked from the suck-out port 14E of the cabinet 14 into the duct 28C together with air sucked from the ventilator 28A. In the middle of the route of the duct 28C, a settling chamber 28D is attached. The settling chamber 28D makes the air containing the sucked dust generate a classification flow, and separates particles in the sucked air. Below the settling chamber 28D, a coarse powder receiving box 28E is disposed, and coarse powder separated by the settling chamber 28D enters the coarse powder receiving box 28E through a pipe 28G. Also, a dust collector (not shown in the figure) is connected to the duct 28C. The dust collector filters the dust in the air passed through the settling chamber 28D and the duct 28C and discharges only clean air to the outside of the device.

As illustrated in FIG. 3, a precoat supply device 28F is connected to the duct 28C. The precoat supply device 28F coats flammable dust with precoat to turn the dust to a flame retardant state, and discharges the dust as dust collector dust. Also, though detailed descriptions are omitted, the shot peening device 10 is provided with a platform 98A, a ladder 98B, a control panel 98C and an operation panel 98D.

Next, the product mounting part 18 illustrated in FIG. 4 or the like will be described concretely. As illustrated in FIG. 4, at the product mounting part 18, a large table 30 as the first rotary table is disposed. The large table 30 is made rotatable (revolvable) about a rotary shaft 31 in the device up-down direction, and is disposed at the position including the projection range (both sides of the projection range are indicated by two-dot chain lines S) where the projection material is projected by the projector 20, and the non-projection range outside the projection range. Then, the space above the large table 30 has a projection area A3 (projection station) where the projection is performed to the workpiece 12 by the projector 20, a carry-in area A1 (carry-in station) adjacent to the carry-in port 14A (see FIG. 1) for carrying in the workpiece 12, and a carry-out area A5 (carry-out station) adjacent to the carry-out port 14B (see FIG. 1) for carrying out the workpiece 12. In the figure, the rotating direction of the large table 30 (in other words, the carrying direction of the workpiece 12) is indicated by an arrow X, the carry-in direction of the workpiece 12 is indicated by an arrow IN, and the carry-out direction of the workpiece 12 is indicated by an arrow OUT.

Above the large table 30, a disk-like top plate member 16A (see FIG. 6) rotated coaxially and integrally with the rotary shaft 31 facing the large table 30 is provided, and the large table 30 and the top plate member 16A (see FIG. 6) are connected by a column member 16B in the device up-down direction. The top plate member 16A (see FIG. 6) is set to be smaller in diameter than the large table 30 in the plan view. The column member 16B is disposed around the rotary shaft 31, partitions the disposing area of a small table 32 as the second rotary table described later and an area on the side of the rotary shaft 31, and partitions the disposing area of the small table 32 equally in a circumferential direction to form a plurality of (five, in the present embodiment) processing chambers R.

When describing the processing chamber R, the processing chamber R is disposed in the internal space of the cabinet 14 and is a chamber that can be any of a carry-in chamber R1, a carry-in side seal chamber R2, a projection chamber R3, a carry-out side seal chamber R4,and a carry-out chamber R5 by rotational displacement of the large table 30. Here, the carry-in chamber R1 is a chamber disposed in the carry-in area A1 of the shot peening device 10 and is for carrying in the workpiece 12, the projection chamber R3 is a chamber disposed in the projection area A3 of the shot peening device 10 and is for performing peening (surface processing) of the workpiece 12 by the projection of the projection material to the workpiece 12, and the carry-out chamber R5 is a chamber disposed in the carry-out area A5 of the shot peening device 10 and is for carrying out the workpiece 12. Also, the carry-in side seal chamber R2 is a chamber disposed between the carry-in area A1 and the projection area A3 in order to prevent the projection material from leaking out from the projection chamber R3 to the carry-in chamber R1, and the carry-out side seal chamber R4 is a chamber disposed between the projection area A3 and the carry-out area A5 in order to prevent the projection material from leaking out from the projection chamber R3 to the carry-out chamber R5. In other words, for instance, for the processing chamber R which is the carry-in chamber R1 at first, the role of the chamber is changed in the order of the carry-in side seal chamber R2, the projection chamber R3, the carry-out side seal chamber R4 and the carry-out chamber R5 as the large table 30 is rotationally displaced by a prescribed angle (72°, in the present embodiment) each around the rotary shaft 31.

A ceiling part of the cabinet 14 is formed such that a part corresponding to the carry-in chamber R1 and the carry-out chamber R5 (more on the outer peripheral side than the top plate member 16A (see FIG. 6)) is turned to an open state. Thus, even when the workpiece 12 is a so-called long object such as a coil spring product, the workpiece 12 can be easily taken in and out from the device upper side (easily attached and detached to/from the small table 32 described later, consequently).

Rubber seals are provided on the side of the cabinet 14 in order to seal a gap between a partition part from the projection chamber R3 and a partition part from the carry-in chamber R1 in the carry-in side seal chamber R2 and a partition part from the projection chamber R3 and a partition part from the carry-out chamber R5 in the carry-out side seal chamber R4, and the peripheral part. By the rubber seals, the projected projection material is intercepted and leakage (scattering) of the projection material is prevented.

On the large table 30, the plurality of small tables 32 are arranged side by side in the circumferential direction at positions on the concentric circle of the large table 30. That is, the product mounting part 18 is in a so-called multi-table structure. In the present embodiment, two small tables 32 each are disposed in each processing chamber R (ten small tables, in total). The small table 32 is made smaller in diameter than the large table 30, and has a rotary shaft 33 parallel to the rotary shaft 31 of the large table 30 to be rotatable, and the workpiece 12 is mounted through an attaching tool 29 (see FIG. 6). For the attaching tool 29 (see FIG. 6), when the workpiece 12 is a coil spring, a column part coaxial with the rotary shaft 33 is erected so as to set the coil spring in an erected state (the state that an axial direction is a vertical direction).

The workpieces 12 on the two small tables 32 disposed in the projection chamber R3 are subjected to the projection (peening) of the projection material from each of upper and lower projectors 20 respectively and are simultaneously processed. Also, since the projection material reflected on the inner wall of the projection chamber R3 also hits the workpiece 12 inside the projection chamber R3 other than the direct projection from the projector 20, efficient peening is made possible.

Figure 6:
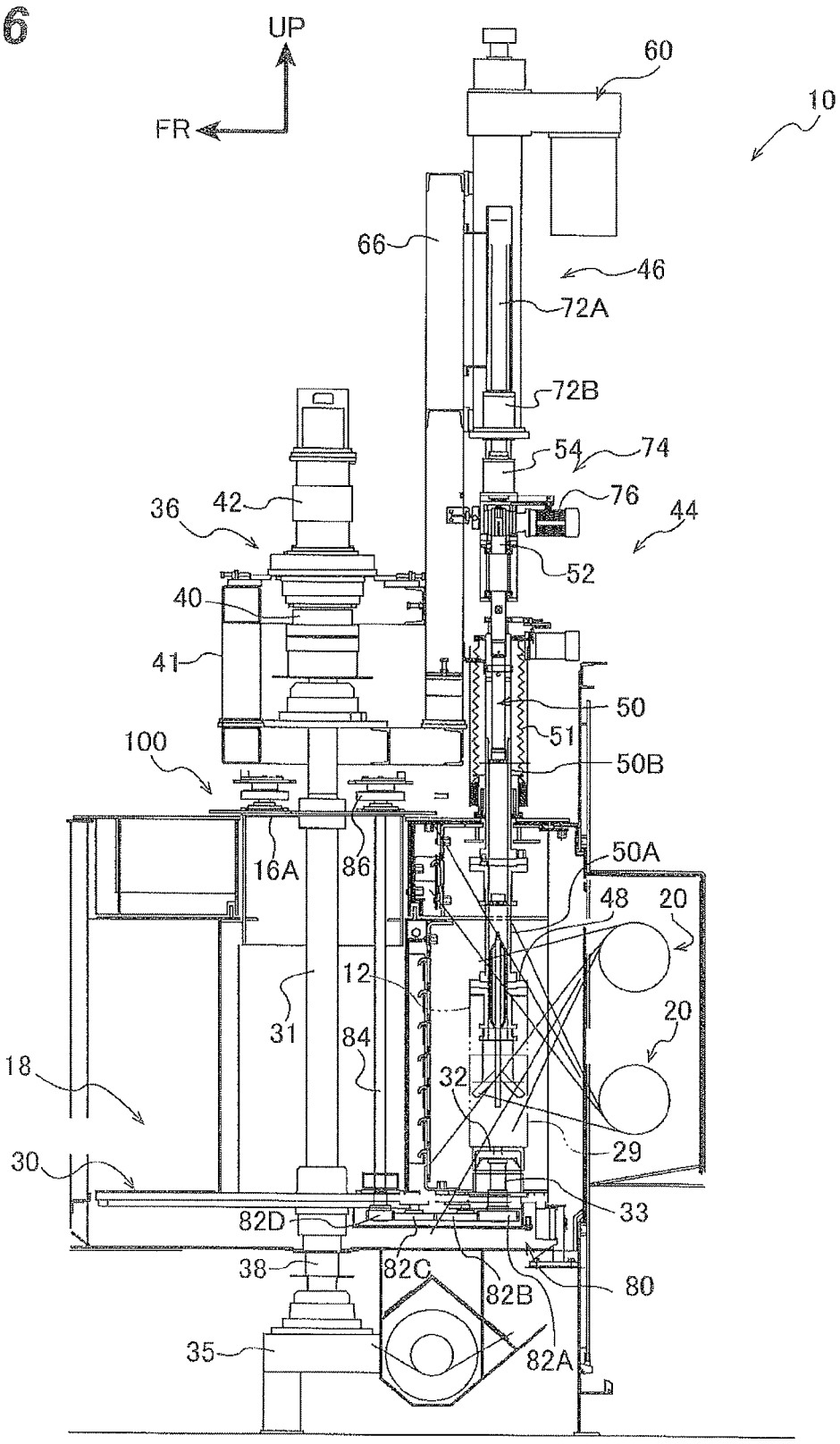
FIG. 6 is a cross sectional view illustrating a main section of the shot peening device according to one embodiment by a right side view.

In FIG. 6, a main section of the shot peening device 10 is illustrated by a cross section view of a right side view. As illustrated in FIG. 6, the shot peening device 10 includes a first drive mechanism 36 for rotationally driving the large table 30. That is, the lower end of the rotary shaft 31 of the large table 30 is disposed on a base part 35 through a bearing part 38, and the upper end of the rotary shaft 31 of the large table 30 is connected to an index device 42 through a torque limiter 40 (coupling). The torque limiter 40 prevents excessive torque from acting on the index device 42, and is attached to the side of a device frame 41.

The index device 42 includes a servo motor for cyclically feeding the large table 30, though detailed illustrations are omitted since a well-known index device is applied. Thus, the index device 42 is loaded with the large table 30 on the base part 35 so as to be rotated and indexed at a prescribed rotating angle position and clamped (held) at the index position, and rotates the large table 30 about the rotary shaft 31 thereof at every rotating angle (72°, in the present embodiment) according to the number (five, in the present embodiment) of the processing chambers R on the large table 30. In other words, the index device 42 rotates (cyclically feeds) the large table 30 about the rotary shaft 31 of the large table 30 at every rotating angle set according to the disposition of the small tables 32. Also, in the state that the index device 42 temporarily stops the large table 30, as illustrated in FIG. 4, it is set to dispose one (any two, in the present embodiment) of the small tables 32 in the projection range in the large table 30.

Figure 10:
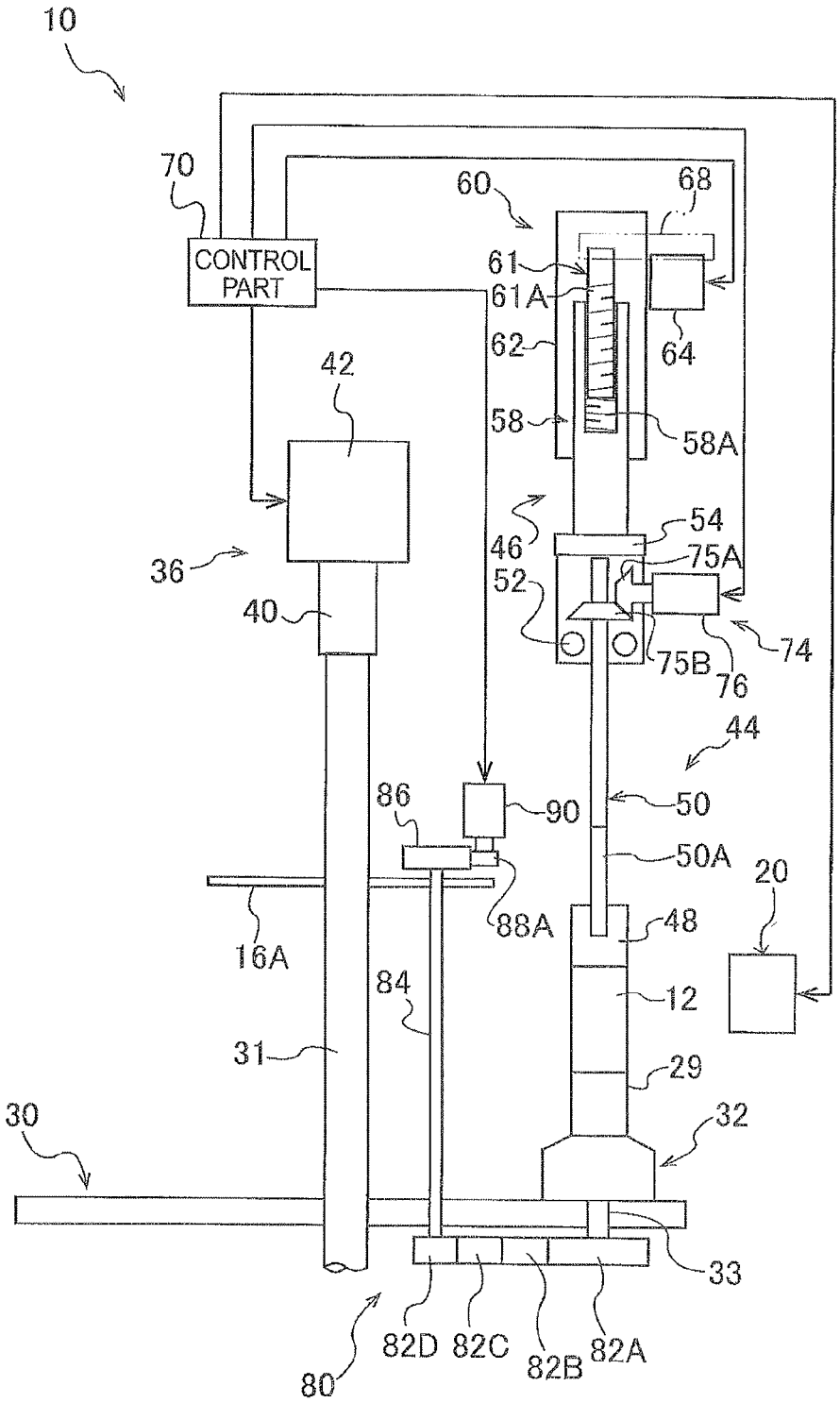
FIG. 10 is a schematic diagram for describing drive control of the shot peening device according to one embodiment.

As illustrated in FIG. 10, the index device 42 is connected to the control part 70. The control part 70 executes control so as to perform tact operation (rotation) of the large table 30 by the index device 42 after the projection by the projector 20 is temporarily stopped (interrupted), and executes control so as to perform the projection by the projector 20 when the large table 30 is temporarily stopped. Thus, the leakage (scattering) of the projection material from the projection chamber R3 (see FIG. 4) to the outdoors is suppressed.

Also, as illustrated in FIG. 6, the shot peening device 10 includes a second drive mechanism 80 for rotationally driving (rotating) the small table 32 when the small table 32 reaches a prescribed projection position. Hereinafter, the second drive mechanism 80 will be described.

Below the small table 32, a gear 82A fixed coaxially with the rotary shaft 33 to the lower end of the rotary shaft 33 passing through the large table 30 is disposed. The gear 82A is connected to a gear 82D disposed near the lower surface side center of the large table 30 through gears 82B and 82C. The gear 82D is coaxially fixed to the lower end of a driving force transmission shaft 84 disposed along the vertical direction. The driving force transmission shaft 84 passes through the large table 30 and the top plate member 16A. Also, the lower end of the driving force transmission shaft 84 is supported through a bearing on the side of the large table 30, the upper end of the driving force transmission shaft 84 is supported through a bearing on the side of the top plate member 16A, and a chain wheel 86 is coaxially fixed. The chain wheel 86 is disposed more on the upper side than the top plate member 16A.

Figure 9:
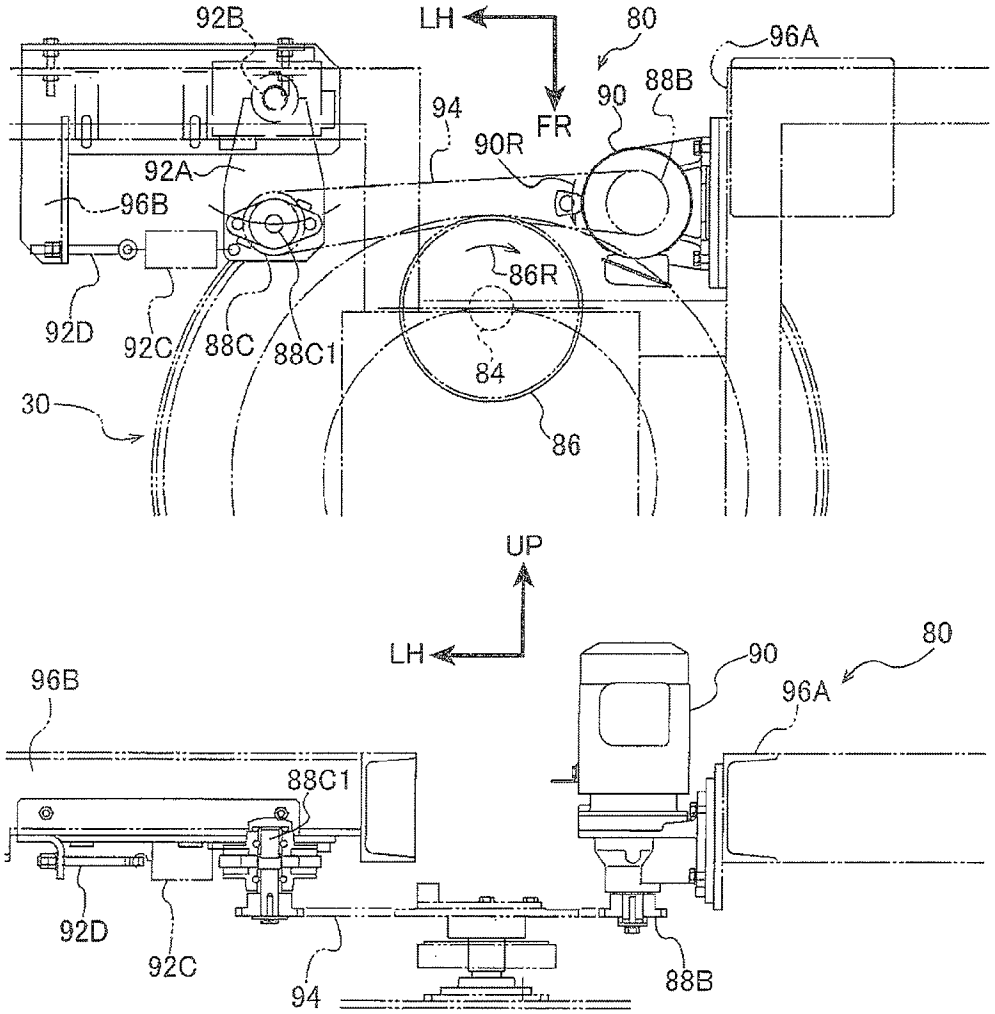
FIG. 9 is a diagram illustrating a drive system of a small table of the shot peening device according to one embodiment.

As illustrated in FIG. 9, the chain wheel 86 is brought into contact with a chain 94 when reaching a prescribed position (specifically a position in the state that the small table 32 (see FIG. 4) to which the chain wheel 86 is connected through the driving force transmission shaft 84 or the like is disposed at the projection position) accompanying the rotation of the large table 30. The chain 94 is endless and is wound around a driving side chain wheel 88B and a driven side chain wheel 88C. The driving side chain wheel 88B is coaxially fixed to a motor shaft of a drive motor 90, and the drive motor 90 is fixed to the side of a device frame 96A, is also connected to the control part 70 illustrated in FIG. 10, and is driven at the prescribed time (when power of a device body is supplied in the present embodiment).

The driven side chain wheel 88C constitutes a pillow unit, and a shaft part 88C1 is rotatably attached to the distal end of an arm 92A. Of the arm 92A, a proximal end is made swingable around a rotary shaft 92B along the device up-down direction, and a distal end is attached to a tension bolt 92D through a spring 92C. The tension bolt 92D is fixed to a device frame 96B. By these, the driven side chain wheel 88C receives tension to the left side in the figure at all times. Therefore, the chain 94 transmits driving force from the drive motor 90 to the chain wheel 86 when the chain wheel 86 reaches the prescribed position. Then, in this structure, unreasonable loads are not easily applied to the chain 94 and the chain wheel 86. Also, an arrow 90R indicated around the drive motor 90 in the figure indicates the rotating direction of the drive motor 90, and an arrow 86R indicated at the chain wheel 86 indicates the rotating direction of the chain wheel 86 when the drive motor 90 is driven.

Meanwhile, as illustrated in FIG. 6, above the projection range in the large table 30, a pressing mechanism 44 is disposed. The pressing mechanism 44 includes a pressing part 48 for pressing the workpiece 12 on the small table 32 from the upper side.

The pressing part 48 is movable up and down between the withdrawn position spaced above the workpiece 12 on the large table 30 and the pressing position for pressing the workpiece 12 on the large table 30 from the upper side. Also, the pressing part 48, as one example, includes a part to be in contact with the upper end of the workpiece 12 and also includes a part to enter the inner side of the workpiece 12 (coil spring). The pressing part 48 is elevated and lowered by an elevating/lowering mechanism 46. Hereinafter, the elevating/lowering mechanism 46 and the peripheral structure thereof will be described.

The pressing part 48 is fixed to the lower end of a pressing shaft 50. The pressing shaft 50 is constituted by connecting a plurality of shafts 50A and 50B in series. Then, the lower part of the pressing shaft 50 is constituted of a distal end shaft 50A, and the pressing part 48 is fixed to the distal end shaft 50A. The pressing shaft 50 constitutes a part of the elevating/lowering mechanism, is disposed coaxially with the rotary shaft 33 of the small table 32 above the small table 32, and has a bellows-like cover 51 on the outer peripheral side. The upper end of the pressing shaft 50 is supported by a bearing 52 provided on the lower end of a pressing frame 54. The pressing shaft 50 is relatively immovable in the up-down direction to the pressing frame 54 and the bearing 52, but is rotatable about the axis of the pressing shaft 50 to the pressing frame 54 and the bearing 52. Thus, the pressing part 48 is made rotatable about the axis in the device up-down direction together with the pressing shaft 50.

Shafts 50A and 50B of the pressing shaft 50 are fixed to each other by a fixture at a flange part. That is, the distal end shaft 50A constituting the lower part of the pressing shaft 50 is detachably provided. As additional descriptions, since it is assumed that the distal end shaft 50A is to be worn away by the projection material, the pressing shaft 50 is turned to such a structure that the distal end shaft 50A can be replaced (in other words, such a structure that the plurality of shafts 50A and 50B connected in series can be disassembled).

Figure 7:
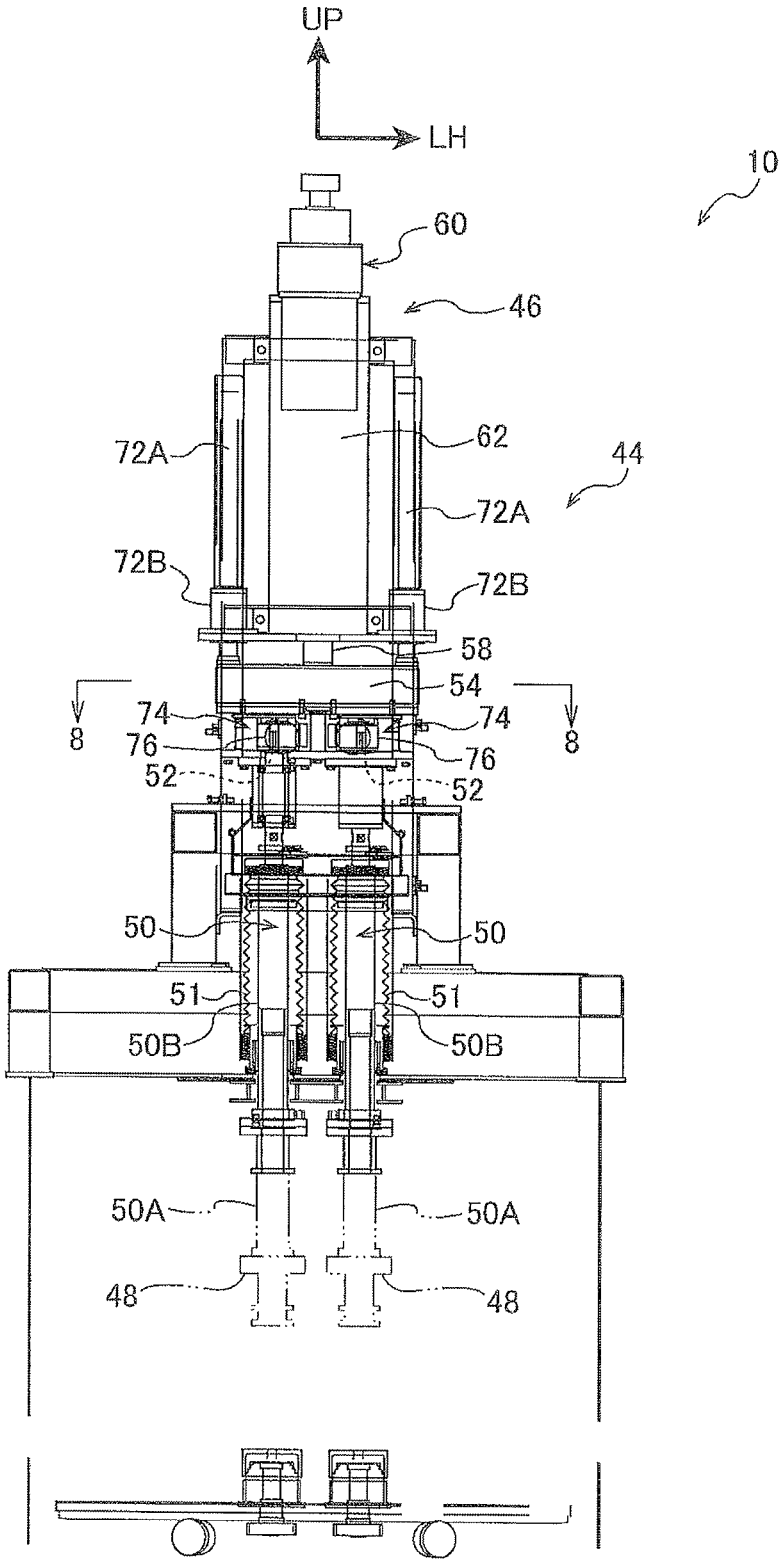
FIG. 7 is a rear view illustrating a pressing mechanism or the like of the shot peening device according to one embodiment.

In FIG. 7, the pressing mechanism 44 or the like is illustrated by a rear view. As illustrated in FIG. 7, the upper end of the pressing frame 54 is fixed to the lower end of an elevating/lowering rod 58 at the width direction center part thereof. The elevating/lowering rod 58 is disposed along the vertical direction, the upper part thereof is disposed inside a cylinder 62 of a servo cylinder 60, and a female screw part 58A is formed at the upper part as illustrated in FIG. 10. Also, the female screw part 58A is engaged with a male screw part 61A of a ball screw 61, and the elevating/lowering rod 58 is disposed relatively non-rotatably around the axis in the up-down direction to the cylinder 62. Also, the ball screw 61 is disposed with the device up-down direction as an axial direction and is rotatable around the axis thereof, and the cylinder 62 of the servo cylinder 60 is fixed to a device frame 66 (see FIG. 6). While the detailed descriptions of the structure of the servo cylinder 60 are omitted since it is a well-known structure, a position detector or the like is built in so that the position of the elevating/lowering rod 58 or the like can be highly accurately controlled.

The elevating/lowering rod 58 is relatively movable (movable back and forth in the up-down direction) to the cylinder 62 by the rotation of the ball screw 61 inside the cylinder 62. That is, in the pressing mechanism 44, by the back and forth movement of the elevating/lowering rod 58 in the up-down direction, the pressing frame 54, the bearing 52, the pressing shaft 50 and the pressing part 48 are linked with that and displaced in the device up-down direction.

The servo cylinder 60 includes an electric servo motor 64. The electric servo motor 64 is for rotationally driving the ball screw 61, and a motor shaft is connected to the ball screw 61 through a gear train 68. The electric servo motor 64 is also connected to the control part 70 of a servo controller. For the servo cylinder 60, since the electric servo motor 64 is controlled on the basis of a command from the control part 70 and a position detection result and the like, motor output by the electric servo motor 64 is turned to desired output. Then, power is supplied from the electric servo motor 64 to the ball screw 61. Thus, for the elevating/lowering rod 58, direction control (elevating/lowering control) is accurately performed so that the pressing part 48 is set at a position at which appropriate stress can be applied to the workpiece 12.

Then, in the present embodiment, at the timing that the small table 32 on which the workpiece 12 is mounted reaches the projection position, the control part 70 operates the servo cylinder 60 to press down the pressing part 48, and thus the workpiece 12 is fixed while optimum stress is accurately applied to the workpiece 12. Also, when cyclically feeding the large table 30 by the first drive mechanism 36, the control part 70 stops the supply of the projection material by the flow rate adjusting device 24 (see FIG. 5) first in order to prevent leakage of the projection material, operates the servo cylinder 60 thereafter to withdraw the pressing part 48 to the upper side, and cyclically feeds the large table 30 by the first drive mechanism 36 finally.

As illustrated in FIG. 7, at the upper end of the pressing frame 54, the lower end of a guide rod 72A is fixed to both sides in the width direction thereof. The guide rod 72A is disposed along the vertical direction, and passes through a through part of a cylindrical rod holder 72B in such a state that relative displacement in the up-down direction is possible. The rod holder 72B is fixed to the device frame 66 (see FIG. 6).

That is, a structure is such that, when the pressing frame 54 is moved in the device up-down direction, the guide rod 72A is displaced in the up-down direction while being guided by the rod holder 72B. Therefore, the pressing frame 54, the bearing 52, the pressing shaft 50 and the pressing part 48 illustrated in FIG. 6 are stably moved in the device up-down direction without being shifted in the device left-right direction.

Figure 8:
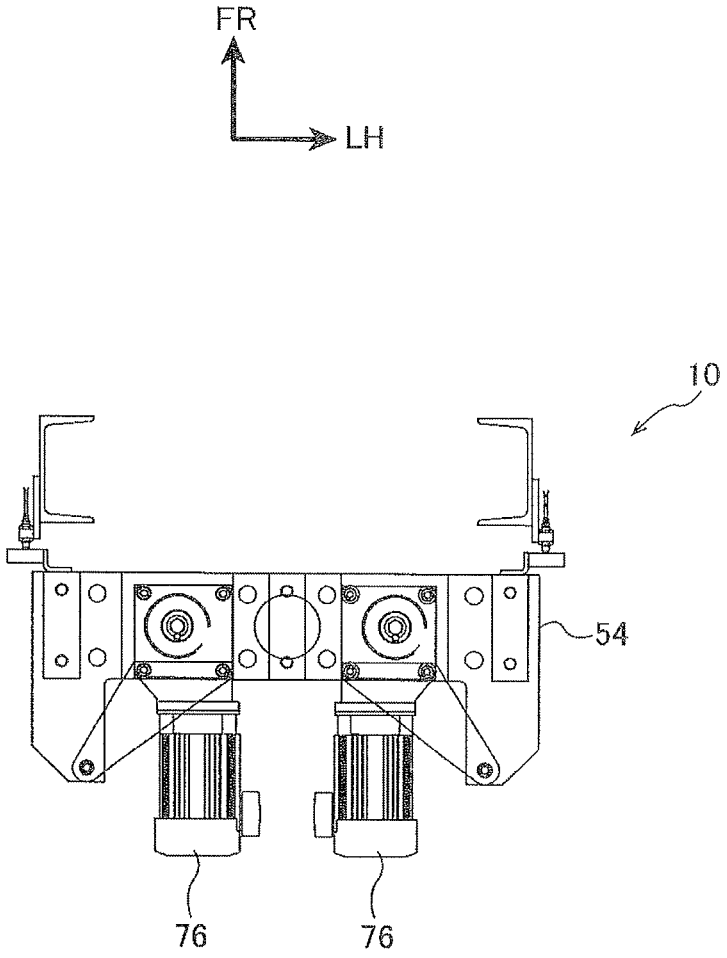
FIG. 8 is an enlarged sectional view along the 8-8 line of FIG. 7.

Also, the pressing mechanism 44 includes a third drive mechanism 74 for rotationally driving the pressing part 48 coaxially with the rotary shaft 33 of the small table 32 and in the same rotating direction and at the same rotating speed as the small table 32. The third drive mechanism 74 includes a drive motor 76 disposed adjacently to the bearing 52. As illustrated in FIG. 7 and FIG. 8 equivalent to an enlarged sectional view along the 8-8 line of FIG. 7, the drive motor 76 is provided for each pressing shaft 50 (see FIG. 7), and two drive motors in total are disposed in the present embodiment.

As illustrated in FIG. 10, to a motor shaft of the drive motor 76, a bevel gear 75A is coaxially fixed. The bevel gear 75A is engaged with a bevel gear 75B coaxially fixed to the upper part of the pressing shaft 50. The drive motor 76 is connected to the control part 70, and is driven when the power of the device body is supplied as an example in the present embodiment. Then, by the drive of the drive motor 76, the pressing shaft 50 and the pressing part 48 are rotated around the axis in the device up-down direction through the bevel gears 75A and 75B.

That is, the third drive mechanism 74 rotationally drives (rotates) the pressing part 48 continuously in the states including the state where the workpiece 12 is disposed in the projection range and the pressing part 48 is lowered in a direction of the pressing position from the withdrawn position, the state where the workpiece 12 is disposed in the projection range and the pressing part 48 is disposed at the pressing position, and the state where the workpiece 12 is disposed in the projection range and the pressing part 48 is elevated in a direction of the withdrawn position from the pressing position.

As described above, the pressing part 48 can be stably displaced to a position matched with the upper end position of the workpiece 12, and the workpiece 12 is rotated around the axis in the device up-down direction together with the small table 32.

Also, in the present embodiment, the index device 42 for rotationally driving the large table 30 (for the first drive mechanism 36), the drive motor 90 for rotationally driving the small table 32 (for the second drive mechanism 80), and the drive motor 76 for rotationally driving the pressing part 48 (for the third drive mechanism 74) are disposed altogether above a device ceiling part 100 (see FIG. 6).

(Shot Processing Method and Functions/Effects)

Figure 11:
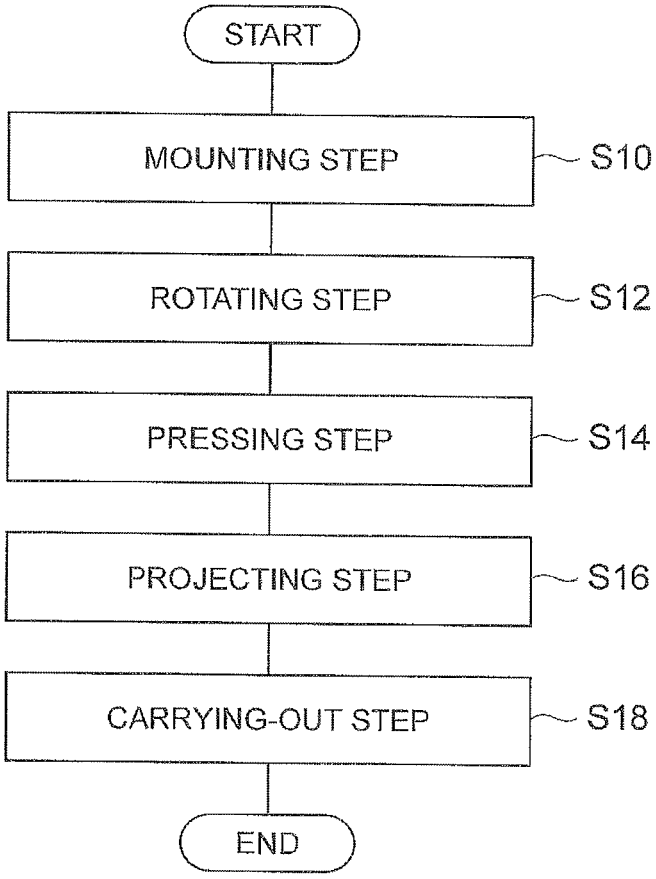
FIG. 11 is a flowchart of the shot peening method according to one embodiment.

Next, while describing the shot processing method using the shot peening device 10 of the above-described configuration with the use of FIG. 11, functions and effects of the embodiment will be described. FIG. 11 is a flowchart indicating the operation of the shot peening device 10.

As indicated in FIG. 11, first, in a mounting step (S10), the workpiece 12 is mounted on the small table 32 inside the carry-in chamber R1 disposed in the carry-in area A1 illustrated in FIG. 4. As previously described, the plurality of small tables 32 are disposed on the rotatable large table 30, and have the rotary shaft 33 parallel to the rotary shaft 31 of the large table 30 to be rotatable. Also, when the workpiece 12 is a coil spring, the coil spring is set in an erected state (the state that the axial direction is the vertical direction).

Then, in a rotating step (S12) after the mounting step, the first drive mechanism 36 (see FIG. 10) rotationally drives the large table 30 by a prescribed angle about the rotary shaft 31 thereof, and temporarily stops the large table 30 at a prescribed position. Also, when the small table 32 reaches the projection range (projection area A3 in other words) where the projection material is projected, the second drive mechanism 80 (see FIG. 10) rotationally drives the small table 32 about the rotary shaft 33 thereof.

Then, in a pressing step (S14), as illustrated in FIG. 6, by the pressing part 48 rotationally driven coaxially with the rotary shaft 33 of the small table 32 and in the same rotating direction and at the same rotating speed as the small table 32, the workpiece 12 is pressed from the upper side after the rotating step. At the time, the pressing part 48 is lowered by the elevating/lowering mechanism 46, and is rotated by the third drive mechanism 74. Also, since the elevating/lowering mechanism 46 includes the servo cylinder 60, the workpiece 12 is pressed with appropriate pressurizing force by the pressing part 48.

The pressing part 48 is rotationally driven by the third drive mechanism 74 not only when pressing the workpiece 12 but also before and after that. Therefore, immediately after the workpiece 12 is pressed by the pressing part 48, the small table 32 and the pressing part 48 are synchronized, the workpiece 12 is stably rotated, and the state continues while the workpiece 12 is pressed by the pressing part 48.

Then, in a projecting step (S16) after the pressing step, to the workpiece 12 which is held by both of the small table 32 and the pressing part 48 and receives rotating force, the projector 20 projects the projection material from an oblique upper side and an oblique lower side. Thus, rotation defects due to a slip or the like are suppressed, and the projection material is projected while the workpiece 12 is stably rotated. As a result, since peening without irregularities is performed, an excellent peening result is obtained.

Next, after the projecting step is ended by ending the projection by the projector 20 and the elevating/lowering mechanism 46 elevates the pressing part 48 in the direction of the withdrawn position from the pressing position, the first drive mechanism 36 rotationally drives the large table 30 by the prescribed angle about the rotary shaft 31 thereof. Then, when the small table 32 reaches the carry-out area A5 illustrated in FIG. 4 and the large table 30 is temporarily stopped, the workpiece 12 is lowered from the small table 32 inside the carry-out chamber R5 (carrying-out step: S18). Incidentally, since the small table 32 is rotationally driven (rotated) only in the projection area A3 and is not rotationally driven (rotated) in the carry-in area A1 and the carry-out area A5, the workpiece 12 can be easily carried in and out.

Needless to say, a series of operations of respective components of the shot peening device 10 are controlled by the control part 70.

As described above, by the shot peening device 10 and the shot processing method according to the present embodiment, the projection material can be projected to the workpiece 12 while the workpiece 12 is stably rotated together with the small table 32.

Also, in the present embodiment, since the workpiece 12 is continuously subjected to stress peening and the time other than the projection time can be reduced, the number of pieces to be peened can be increased, and the stress peening can be efficiently performed.

This point will be additionally described while making a comparison with a comparison structure. For instance, in such a comparison structure that stress is applied to a coil spring which is a workpiece by an attaching jig beforehand and then the coil spring and the attaching jig are integrally set to an attaching jig on a table, the step of applying the stress by the attaching jig to the coil spring beforehand is needed. In contrast, in the present embodiment, since a mechanism of applying the stress to the workpiece 12 (coil spring or the like) is incorporated in the shot peening device 10, the pre-process time like the comparison structure is not needed, and the time other than the projection time is reduced. Also, in the shot peening device 10 according to the present embodiment, since the need of the attaching jig for applying the stress beforehand is eliminated, a processing cost can be reduced as well.

Also, in the present embodiment, as illustrated in FIG. 6, since the distal end shaft 50A to which the pressing part 48 is fixed is detachably provided, the distal end shaft 50A can be replaced when the distal end shaft 50A is worn away by the projection material.

Also, in the present embodiment, since the index device 42 for the first drive mechanism 36, the drive motor 90 (see FIG. 9) for the second drive mechanism 80, and the drive motor 76 for the third drive mechanism 74 are all disposed above the device ceiling part 100, maintenance is facilitated and a compact configuration is made possible.

(Additional Descriptions of Embodiment)

In the embodiment, while the projector is the centrifugal projector 20, the projector may be other projectors such as an air nozzle type projector which forcibly feeds the projection material together with compressed air and jetting it from a nozzle, for instance.

Also, in the embodiment, while the shot processing device is the shot peening device 10, the shot processing device may be other shot processing devices such as a shot blast device. Also, the device having the same configuration as the shot peening device 10 may be used as a shot peening device serving also as a shot blast device.

In the embodiment, while the index device 42 rotates the large table 30 about the rotary shaft 31 by every prescribed rotating angle in the first drive mechanism 36 illustrated in FIG. 6, the first drive mechanism may be a drive mechanism having another structure of providing a position detection sensor for detecting the position of the second rotary table and cyclically feeding (rotating) the first rotary table at the rotating angle according to the position of the second rotary table, for instance.

Also, as a modification of the embodiment, the second drive mechanism may be another drive mechanism including a first engagement part which is disposed below the second rotary table and provided on the rotary shaft of the second rotary table, a second engagement part which is provided below the projection range in the first rotary table and is capable of being engaged with the first engagement part and transmitting rotary driving force in the state of being engaged with the first engagement part, a drive part for rotationally driving the second engagement part, and a contact/separating mechanism for bringing the second engagement part into contact with the first engagement part when the first rotary table is temporarily stopped and separating the second engagement part from the first engagement part when the first rotary table is rotated. Also, a configuration can be such that a first rubber roller is provided instead of the first engagement part in the modification and a second rubber roller is provided instead of the second engagement part.

While the elevating/lowering mechanism 46 includes the servo cylinder 60 in the embodiment, the elevating/lowering mechanism may be an elevating/lowering mechanism including other actuators.

As a modification of the embodiment, for instance, a configuration may be such that, after the workpiece is disposed in the projection range and the pressing part is disposed at the pressing position, the second drive mechanism rotationally drives the second rotary table and the third drive mechanism rotationally drives the pressing part (coaxially with the rotary shaft of the second rotary table and in the same rotating direction and at the same rotating speed as the second rotary table).

Also, as a modification of the embodiment, a rotation detection sensor for detecting the rotation of the pressing part 48 may be provided.

Moreover, as a modification of the embodiment, a configuration may be not the configuration illustrated in FIG. 4 but such that the large table (30) is turned to two areas of the carry-in/carry-out area and the projection area (A3) and the processing chamber (R) can be turned to two chambers of the projection chamber (R3) and a carry-in/carry-out chamber. Also, a configuration may be such that the large table (30) is turned to the carry-in/carry-out area, the projection area (A3) and an intermediate area (provided between the carry-in/carry-out area and the projection area (A3)), and the processing chamber (R) can be turned to the projection chamber (R3), the carry-in/carry-out chamber and a seal chamber (the chamber corresponding to the carry-in side seal chamber R2 and the carry-out side seal chamber R4 of the embodiment).

That is, as a modification of the embodiment, in the space above the large table (30), the projection area (A3) where the projection is performed to the workpiece (12) by the projector (20) and the carry-in/carry-out area adjacent to the carry-in/carry-out port for carrying in and out the workpiece (12) may be provided. In the configuration of such a modification, the workpiece (12) is carried in from the carry-in/carry-out port to the carry-in/carry-out area, made to reach the projection area (A3) by the rotation of the large table (30), projected by the projector (20) in the projection area (A3), made to reach the carry-in/carry-out area by the rotation of the large table (30), and carried out from the carry-in/carry-out area through the carry-in/carry-out port.

Also, in the modification, a configuration may be such that the blow-down area for blowing down the projection material on the workpiece (12) is provided in a part of the space above the large table (30), more on the downstream side of the rotating direction of the large table (30) than the projection area (A3) and more on the upstream side of the rotating direction of the large table (30) than the carry-in/carry-out area, the blowing port of the blowing device is disposed facing the blow-down area, and the blowing device is capable of blowing air to the workpiece (12). By such a configuration, the projection material or the like remaining on the workpiece (12) is blown down by blowing of air by the blowing device.

As another modification, a configuration may be such that two projection chambers (R3) are provided or a configuration may be such that three small tables (32) are mounted on one processing chamber (R).

Further, as a modification of the embodiment, a configuration may be such that the blow-down area for blowing down the projection material on the workpiece (12) is provided in a part of the space above the large table (30), more on the downstream side of the rotating direction of the large table (30) than the projection area (A3) and more on the upstream side of the rotating direction of the large table (30) than the carry-out area (AS), the blowing port of the blowing device is disposed facing the blow-down area, and the blowing device is capable of blowing air to the workpiece (12). That is, a blow-down chamber for blowing down the projection material on the workpiece (12) may be provided between the projection chamber (R3) and the carry-out chamber (R5) in the embodiment (a setting position of the carry-out side seal chamber R4 of the embodiment), and the blow-down device may be disposed. By such a configuration, the projection material or the like remaining on the workpiece (12) is blown down by blowing of air by the blowing device.

While the small table 32 is rotationally driven about the rotary shaft 33 thereof only in the state that the small table 32 is disposed in the projection range where the projection material is projected in the embodiment, the small table 32 may be rotationally driven about the rotary shaft 33 thereof not only in the state that the small table 32 is disposed in the projection range where the projection material is projected but also in the state including some of the states before and after that. Also, the second drive mechanism may be provided for each small table 32 (second rotary table) to control rotational drive.

In the embodiment, the pressing shaft 50 illustrated in FIG. 6 has a detachable distal end shaft 50A on the lower part thereof, and such a configuration is preferable, however, for instance, a shaft-like member which constitutes a part of the elevating/lowering mechanism (46) and has the pressing part (48) fixed to the lower end thereof may be constituted from one member that cannot be disassembled.

Also, as a modification of the embodiment, a configuration may be such that one or both of the index device (42) and the drive motor (90 (see FIG. 9)) for the second drive mechanism (80) are disposed below the large table (30) as the first rotary table.

Also, the embodiment and the plurality of above-described modifications can be appropriately combined and executed.

REFERENCE SIGNS LIST

10 . . . shot peening device (shot processing device), 12 . . . workpiece, 14A . . . carry-in port, 14B . . . carry-out port, 20 . . . projector, 30 . . . large table (first rotary table), 32 . . . small table (second rotary table), 36 . . . first drive mechanism, 42 . . . index device, 46 . . . elevating/lowering mechanism, 48 . . . pressing part, 50 . . . pressing shaft, 50A . . . distal end shaft, 50B . . . shaft, 60 . . . servo cylinder, 74 . . . third drive mechanism, 76 . . . drive motor for third drive mechanism, 80 . . . second drive mechanism, 90 . . . drive motor for second drive mechanism, 100 . . . device ceiling part, A1 . . . carry-in area, A3 . . . projection area, A5 . . . carry-out area.

The invention claimed is:

1. A shot processing device comprising:

a projector configured to project a projection material to a workpiece;

a rotatable first rotary table which is disposed at a position including a projection range where the projection material is projected by the projector and a non-projection range outside the projection range;

a first drive mechanism configured to rotationally drive the first rotary table;

a plurality of second rotary tables which are disposed on the first rotary table and include a rotary shaft parallel to a rotary shaft of the first rotary table to be rotatable, and on which the workpiece is mounted;

a second drive mechanism configured to rotationally drive the second rotary table;

a pressing part which is provided above the projection range on the first rotary table, and configured to move up and down between a withdrawn position spaced above the workpiece on the second rotary table and a pressing position for pressing the workpiece on the second rotary table from above;

an elevating/lowering mechanism configured to elevate and lower the pressing part;

a third drive mechanism configured to rotationally drive the pressing part coaxially with the rotary shaft of the second rotary table and in the same rotating direction and at the same rotating speed as the second rotary table;

a partition part provided on the first rotary table;

five processing chambers defined by the partition part and arranged in a circumferential direction of the first rotary table; and a liner provided in each of five processing chambers, wherein the partition part includes a center wall and five partition walls, the center wall constructs a pentagonal prism shaped in a cylinder, the pentagonal prism contains the rotary axis of the first rotary table, an axis of the pentagonal prism is coaxial with the rotation axis of the first rotary table, each of the partition walls extends in the radial direction from a bus bar of the pentagonal prism to an edge of the first rotary table and includes a forked distal end, each of the five processing chambers moves along the circumferential direction of the first rotary table in accordance with the rotation of the first rotary table, and sequentially changes into a carry-in chamber, a carry-in side seal chamber, a projection chamber, a carry-out side seal chamber, and a carry-out chamber, the processing chamber that changed to the carry-in chamber and the processing chamber that changed to the carry-out chamber are adjoined, the processing chamber that changed to the carry-in side seal chamber is placed between the processing chamber that changed to the carry-in chamber and the processing chamber that changed to the projection chamber, the process chamber that changed to the carry-out side seal chamber is placed between the processing chamber that changed to the projection chamber and the processing chamber that changed to the carry-out chamber, the liner includes a first shield and a second shield, the first shield is provided between the side wall of the pentagonal prism and the second rotary table, and the first shield is parallel to the side wall of the pentagonal prism, and the second shield is provided between the partition part and the second rotary table, and the second shield is parallel to the partition part.

2. The shot processing device according to claim 1, wherein the elevating/lowering mechanism includes a servo cylinder.

3. The shot processing device according to claim 1, wherein the third drive mechanism rotationally drives the pressing part continuously in states including the state where the workpiece is disposed in the projection range and the pressing part is lowered in a direction from the withdrawn position to the pressing position, the state where the workpiece is disposed in the; projection range and the pressing part is disposed at the pressing position, and the state where the workpiece is disposed in the projection range and the pressing part is elevated in a direction from the pressing position to the withdrawn position.

4. The shot processing device according to claim 1, wherein above the second rotary table, a pressing shaft to a lower end of which the pressing part is fixed and which constitutes a part of the elevating/lowering mechanism is disposed coaxially with the rotary shaft of the second rotary table, and the pressing shaft is constituted by connecting a plurality of shafts in series and has a detachable distal end shaft for fixing the pressing part on a lower part of the pressing shaft.

5. The shot processing device according to claim 1, wherein the first drive mechanism includes an index device, the second drive mechanism includes a drive motor for the second drive mechanism, the third drive mechanism includes a drive motor for the third drive mechanism, and the index device, the drive motor for the second drive mechanism, and the drive motor for the third drive mechanism are all disposed above a device ceiling part.

6. The shot processing device according to claim 1, further including a blowing device configured to blow air to the workpiece in the processing chamber.

7. A shot processing method for the shot processing device according to the claim 1, comprising:

a mounting step of mounting a workpiece on a second rotary table which is disposed on a rotatable first rotary table and includes a rotary shaft parallel to a rotary shaft of the first rotary table to be rotatable;

a rotating step of rotationally driving the first rotary table about the rotary shaft of the first rotary table and rotationally driving the second rotary table about the rotary shaft of the second rotary table at least in a projection range where a projection material is projected, after the mounting step;

a pressing step of pressing the workpiece from above after the rotating step, by a pressing part rotationally driven coaxially with the rotary shaft of the second rotary table and in the same rotating direction and at the same rotation speed as the second rotary table; and a projecting step of projecting the projection material to the workpiece, after the pressing step.

8. The shot processing device according to claim 2, wherein the third drive mechanism rotationally drives the pressing part continuously in states including the state where the workpiece is disposed in the projection range and the pressing part is lowered in a direction from the withdrawn position to the pressing position, the state where the workpiece is disposed in the projection range and the pressing part is disposed at the pressing position, and the state where the workpiece is disposed in the projection range and the pressing part is elevated in a direction from the pressing position to the withdrawn position.

9. The shot processing device according to claim 2, wherein above the second rotary table, a pressing shaft to a lower end of which the pressing part is fixed and which constitutes a part of the elevating/lowering mechanism is disposed coaxially with the rotary shaft of the second rotary table, and the pressing shaft is constituted by connecting a plurality of shafts in series and has a detachable distal end shaft for fixing the pressing part on a lower part of the pressing shaft.

10. The shot processing device according to claim 3, wherein above the second rotary table, a pressing shaft to a lower end of which the pressing part is fixed and which constitutes a part of the elevating/lowering mechanism is disposed coaxially with the rotary shaft of the second rotary table, and the pressing shaft is constituted by connecting a plurality of shafts in series and has a detachable distal end shaft for fixing the pressing part on a lower part of the pressing shaft.

11. The shot processing device according to claim 8, wherein above the second rotary table, a pressing shaft to a lower end of which the pressing part is fixed and which constitutes a part of the elevating/lowering mechanism is disposed coaxially with the rotary shaft of the second rotary table, and the pressing shaft is constituted by connecting a plurality of shafts in series and has a detachable distal end shaft for fixing the pressing part on a lower part of the pressing shaft.

12. The shot processing device according to claim 2, wherein the first drive mechanism includes an index device, the second drive mechanism includes a drive motor for the second drive mechanism, the third drive mechanism includes a drive motor for the third drive mechanism, and the index device, the drive motor for the second drive mechanism, and the drive motor for the third drive mechanism are all disposed above a device ceiling part.

13. The shot processing device according to claim 3, wherein the first drive mechanism includes an index device, the second drive mechanism includes a drive motor for the second drive mechanism, the third drive mechanism includes a drive motor for the third drive mechanism, and the index device, the drive motor for the second drive mechanism, and the drive motor for the third drive mechanism are all disposed above a device ceiling part.

14. The shot processing device according to claim 4, wherein the first drive mechanism includes an index device, the second drive mechanism includes a drive motor for the second drive mechanism, the third drive mechanism includes a drive motor for the third drive mechanism, and the index device, the drive motor for the second drive mechanism, and the drive motor for the third drive mechanism are all disposed above a device ceiling part.

15. The shot processing device according to claim 8, wherein the first drive mechanism includes an index device, the second drive mechanism includes a drive motor for the second drive mechanism, the third drive mechanism includes a drive motor for the third drive mechanism, and the index device, the drive motor for the second drive mechanism, and the drive motor for the third drive mechanism are all disposed above a device ceiling part.

16. The shot processing device according to claim 9, wherein the first drive mechanism includes an index device, the second drive mechanism includes a drive motor for the second drive mechanism, the third drive mechanism includes a drive motor for the third drive mechanism, and the index device, the drive motor for the second drive mechanism, and the drive motor for the third drive mechanism are all disposed above a device ceiling part.

17. The shot processing device according to claim 10, wherein the first drive mechanism includes an index device, the second drive mechanism includes a drive motor for the second drive mechanism, the third drive mechanism includes a drive motor for the third drive mechanism, and the index device, the drive motor for the second drive mechanism, and the drive motor for the third drive mechanism are all disposed above a device ceiling part.

* * * * *